US005642990A

United States Patent [19]

Short

[11] Patent Number: 5,642,990

[45] Date of Patent: Jul. 1, 1997

[54] TRAVELING VALVE BALL DISPLACING TOOL

[76] Inventor: Charles G. Short, HC 31 Box 51V50, Midland, Tex. 79707

[21] Appl. No.: 579,363

[22] Filed: Dec. 27, 1995

[51] Int. Cl.[6] ..... F04B 53/10

[52] U.S. Cl. ..... 417/444; 417/554

[58] Field of Search ..... 417/523, 554, 417/444, 443

[56] References Cited

U.S. PATENT DOCUMENTS

| | | | |
|---|---|---|---|
| 1,676,186 | 7/1928 | Hawkins | 417/444 |
| 2,131,299 | 9/1938 | Reagin | 417/444 X |
| 2,690,134 | 9/1954 | Ritchey | 417/443 |
| 3,215,085 | 11/1965 | Goostree | 417/444 |
| 4,673,338 | 6/1987 | Jones | 417/554 X |
| 4,867,242 | 9/1989 | Hart | 417/554 X |
| 4,907,533 | 3/1990 | Hebert | 417/444 |

FOREIGN PATENT DOCUMENTS

| | | | |
|---|---|---|---|
| 720411 | 2/1932 | France | 417/554 |

*Primary Examiner*—Richard E. Gluck

*Attorney, Agent, or Firm*—Jeffrey D. Myers; Deborah A. Peacock; Donovan F. Duggan

[57] ABSTRACT

A downhole pump is reciprocated subsurface for the purpose of lifting fluid from an underground borehole to the surface or other suitable storage location. As the fluid being pumped may contain gas, the efficiency of the pump may decrease to the point where no fluid is pumped due to the compression and expansion of gas within the downhole pump. This condition is commonly described as gas lock, and, when encountered, can prevent the pump from displacing any fluid, resulting in no efficiency and no work performed. Installed as an integral part of the downhole pump assembly, the device described herein effectively, mechanically, and positively prevents the gas locked condition, and, additionally, efficiently handles suspended solids due to its design incorporating no moving parts nor small fluid passages.

5 Claims, 2 Drawing Sheets

TRAVELING VALVE BALL DISPLACING TOOL

BACKGROUND OF THE INVENTION

The recovery of fluid from an underground borehole can be accomplished by means of artificial lift whereby energy is supplied to downhole equipment and fluid is subsequently lifted to the surface. One type of artificial lift is the reciprocating of a downhole positive displacement pump by means of a reciprocating rod string which is attached to a source of reciprocating power on the surface of the ground above the borehole. Many oil and gas wells use this sort of artificial lift for the economic recovery of fluids from the wellbore.

The wellbore can also contain large amounts of gas, in addition to fluids, which reduce pumping efficiencies and make the task of subsurface pumping more difficult. The downhole pump is designed to pump an incompressible fluid. The presence of gas in large quantities can result in a gas lock condition within the downhole pump. In this condition the pump reciprocation results only in gas expansion and compression, alternately; with no net displacement of fluid and, therefore, no lift. This gas lock condition can exist for several minutes, hours, or even days until increased fluid head or some other factor causes the pump to be forced out of the gas lock and back into the essential fluid pumping operation.

Many gas lock breaking devices exist in the marketplace. However, a high degree of complexity and an inability to handle suspended solids, such as sand, iron sulfide, and scale, have limited the universal application of these devices. The present invention overcomes these limitations by the simplicity of no moving parts and the ability to operate in suspended solids, provided the rest of the pump assembly is designed to handle such solids. The unique way in which the traveling valve ball displacing tool realizes these achievements are the subject of the invention.

SUMMARY OF THE INVENTION

The basic concept of a reciprocating downhole pump effectively lifting fluid is fairly simple and certainly ancient. The pump is basically two chambers within a cylinder, or barrel, which are divided by a traveling piston, or plunger. Two valves, a standing valve and a traveling valve, work with the reciprocating plunger to provide fluid flow to the surface, usually within a string of tubing attached to the outlet of the downhole pump.

As long as the pump assembly is properly designed for the downhole application, the operation of the pump can be dependable and efficient. However, downhole pumps in their simplest form are intended to pump only incompressible fluid. When fluids start to contain large volumes of gas, whether entrained, evolved, or stratified, the efficiency of the pump starts to decrease. As the gas volume accompanying a given fluid volume increases, the efficiency of the downhole pump continues to decrease, in the absence of any pump modifications to enhance gas handling abilities of the pump.

The downhole pump can only function when the reciprocating motion of the plunger within the pump barrel causes the traveling valve to open and pass fluid at some point during the reciprocating stroke. If the pump cavity between the traveling and standing valves becomes filled with gas, and the hydrostatic pressures on either side of the two valves are appropriate, the traveling valve will not open and no fluid will be pumped. It is this condition which defines and stags the gas locking of a downhole pump.

The primary object of the present invention is to mechanically force the traveling valve open on each and every reciprocation of the plunger within the barrel, provided the pump is properly assembled and the pump is spaced properly on the surface at the pumping unit. As long as a high percentage of the fluid entering the pump intake is incompressible fluid, the traveling valve will open at the beginning of the downstroke, and the invention will not affect the normal operation for which the pump is designed. However, if gas interference causes the pump to cease operating due to gas lock, the invention will force the traveling valve open and subsequently rectify the gas lock condition.

Another object of the invention is construction so as to replace a standard connector within a downhole pump assembly. Normally, it will replace the standard connector between the barrel and the standing valve, remaining stationary during the pumping operation. As such, it does not modify the external appearance or dimensions of the pump.

Another and still further object of the invention is the ability to perform reliably in pumping wells with trashy wellbore fluid. The presence of scale, iron sulfide, sand, or other suspended solids within the fluid regime is often detrimental to the dependable operation of devices installed to prevent or assist with gas lock problems. Sliding sleeves, small fluid flow ports, and multiple complex valving designs often fall prey to the affects of these suspended solids. This creates what may be the most difficult oil and gas pumping scenario: high gas volumes, low fluid volumes, and suspended solids. The invention has no moving parts to jam and malfunction, and the large flow paths through the device effectively resist plugging, satisfying this objective.

These and various other objects and advantages of the invention will become readily apparent to those skilled in the art upon reading the following detailed description and claims and by referring to the accompanying drawings.

The above objects are attained in accordance with the present invention by the provision of both method and apparatus which is carried out by means of a combination of elements which are fabricated in a manner substantially as described herein.

CATALOG PARTS

| Item No. | Description |
|---|---|
| 1 | Fluid |
| 2 | Ground Elevation Surface |
| 3 | Pumping Unit |
| 4 | Rod String |
| 5 | Underground Reservoir |
| 6 | Downhole Pump |
| 7 | Tubing String |
| 8 | Surface Fluid Outlet |
| 9 | Casing String |
| 10 | Pump Rod |
| 11 | Pump Plunger |
| 12 | Pump Barrel |
| 13 | Traveling Valve |
| 14 | Standing Valve |
| 15 | Stinger |
| 16 | Traveling Valve Ball Displacing Tool |
| 17 | Traveling Valve Ball |
| 18 | Pump Intake |
| 19 | Standing Valve Assembly |
| 20 | Threads |
| 21 | Wrench Flats |
| 22 | Tool Face |
| 23 | Flow Holes |
| 24 | Interior Flow Area |
| 25 | Longitudinal Axis |

-continued

| CATALOG PARTS | |
|---|---|
| Item No. | Description |
| 26 | Thread 15/16 |
| 27 | Traveling Valve Seat |

DETAILED DESCRIPTION OF THE PREFERRED EMBODIMENTS

Figure 1:
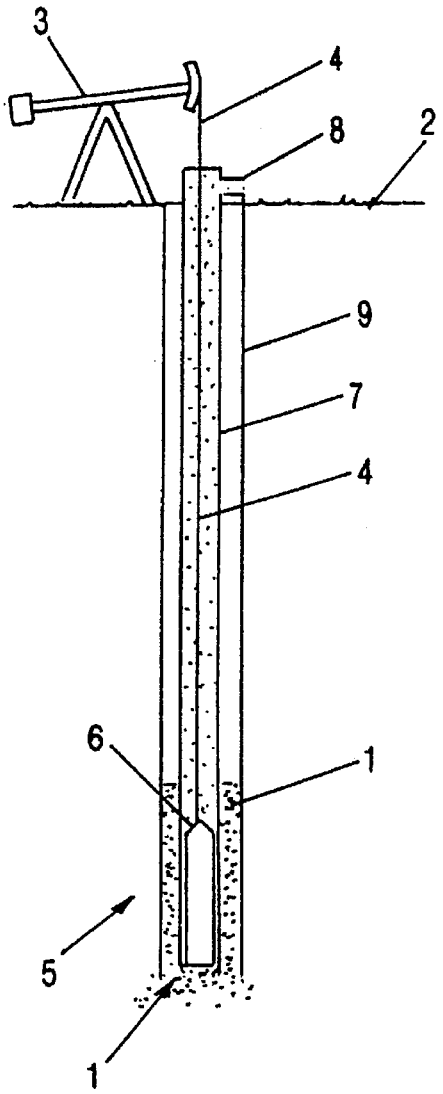
FIG. 1 is a part diagrammatical, part schematical, part cross-sectional view which depicts a generic artificial lift pumping system using a downhole pump.

FIG. 1 shows a typical oil and gas well pumping system used to lift the fluid 1 from the underground reservoir 5 to the surface 2. The pumping unit 3 powers the rod string 4 and thence the downhole pump 6 in a reciprocating motion. The downhole pump 6 is seated in the bottom of a tubing string 7, which tubing string serves as a conductor for fluid flow to the surface fluid outlet 8. The underground borehole is usually lined with one or more casing strings 9 for fluid containment and effective borehole zonal isolation.

Figure 2:
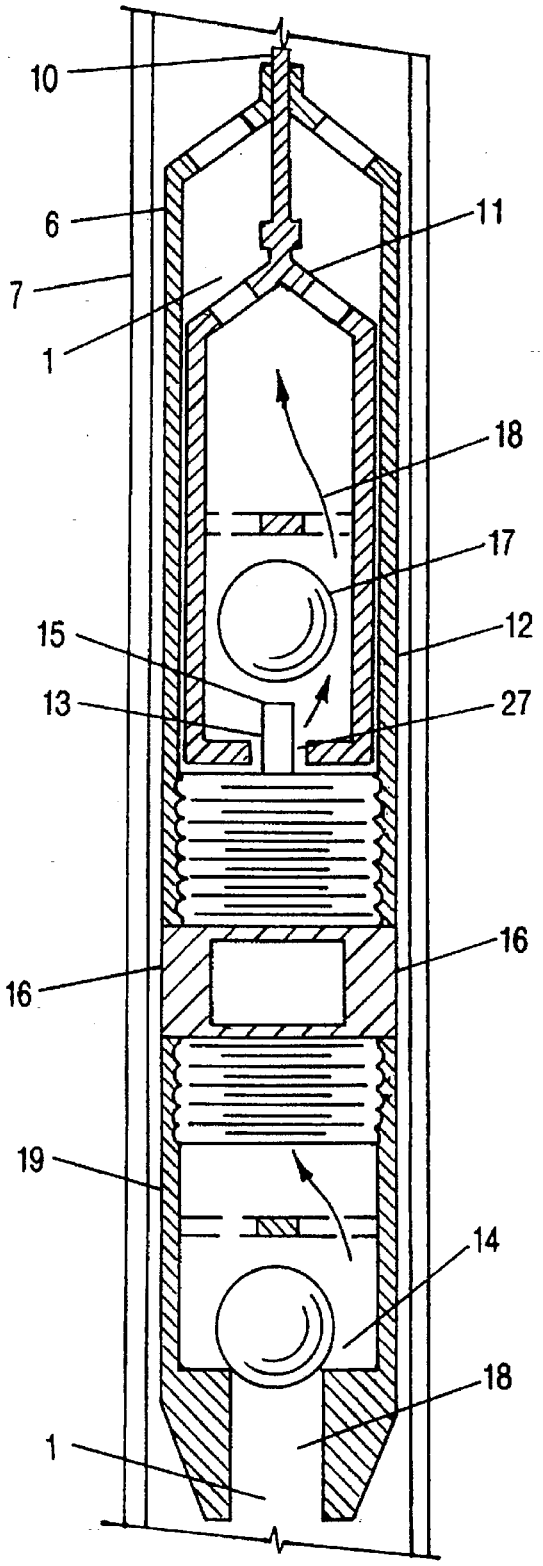
FIG. 2 is an enlarged detailed cross-sectional view which shows the details of the downhole pump, including the installation of the present invention.

FIG. 2 indicates an enlarged detail of the downhole pump 6 and its proximate operating environment and includes the present invention 16 incorporated therewith. As the bottom of the rod string 4 reciprocates the pump rod 10, the attached pump plunger 11 travels up and down within the stationary pump barrel 12. As the plunger 11 moves downward the traveling valve 13 is forced open by either incompressible fluid 1 in the pump barrel 12 above the standing valve 14, or, in the case of a gas interference or lock condition, by the stinger 15 of the present invention 16 mechanically deflecting the traveling valve ball 17, either of which conditions allows a fluid flow 18 through the pump.

As the pump plunger 11 travels upward the hydrostatic weight of the fluid 1 will cause the traveling valve ball 17 to drop, effectively closing the traveling valve 13, and allowing fluid to enter the pump intake 18 and open the standing valve 14. As the pump plunger 11 reaches the top of the reciprocating stroke the cycle is completed. The repetitive strokes of the pump 11 furnishes the hydraulic horsepower necessary to lift the fluid to the surface 2.

The invention 16 replaces a standard downhole pump connector which attaches the standing valve assembly 19 to the pump barrel 12 in the downhole pump 6.

Figure 3:
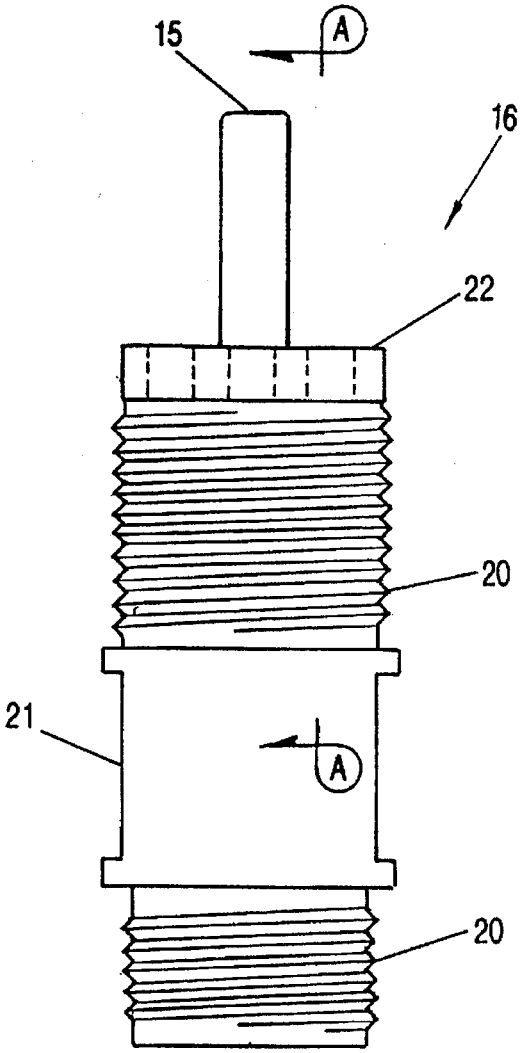
FIG. 3 is an isolated side view of the invention.

FIG. 3 shows a side view of the invention 16. The stinger 15 is rigidly attached to and integrally part of the present invention 16. The tip of the stinger is radiused at the edges to protect the traveling valve ball 17. The threads 20 are designed to fit the pump barrel 12 and the standing valve assembly 19, using standard pump components and threads. The wrench flats 21 fit standard pump shop wrench sizes. The tool face 22 of the invention 16 is machined and furnishes increased protection to downhole pump components from the common practice of tagging the pump.

Figure 4:
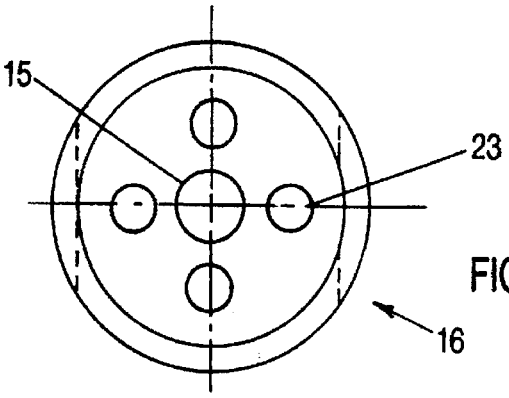
FIG. 4 is a top view of the invention of FIG. 3.

FIG. 4 shows a top view of the invention 16 which shows holes or a plurality of passageways 23 through which fluid flows as it is pumped. The large size of the passageways 23 encourage fluid flow and discourage plugging by solids suspended in the pumped fluid 1. The passageways 23 are parallel to one another and to a longitudinal axis 25, along which stinger 15 is located.

Figure 5:
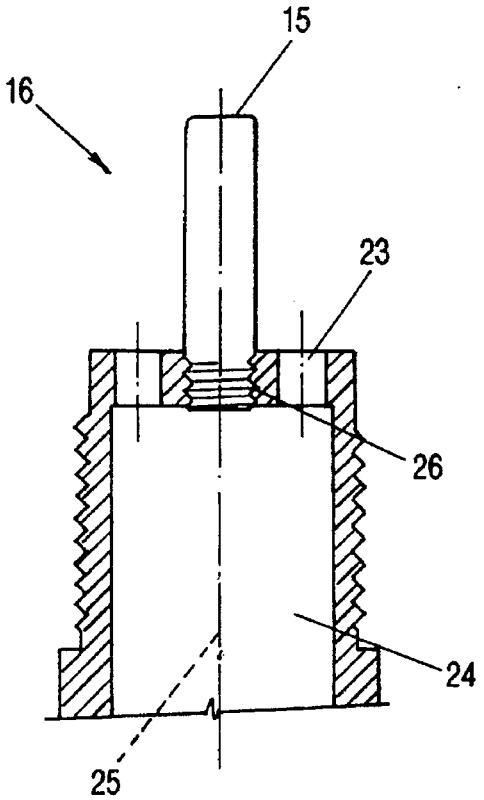
FIG. 5 is a cross-sectional view of the invention of FIG. 3.

FIG. 5 shows a cross-sectional view which indicates the large interior flow area 24 of the invention 16.

I claim:

1. A downhole pump apparatus having a pump plunger reciprocatingly received within a pump barrel; a traveling valve seat comprising an intermediate planar perforate cage member within said plunger forming an opening into said plunger for the flow of produced fluid; a caged traveling valve ball received in said traveling valve seat within said plunger; a standing valve assembly forming an inlet into said downhole pump; a traveling valve ball displacing tool containing internal flow passageways for conducting fluid flow from said standing valve assembly inlet to said traveling valve seat opening; said standing valve assembly being separated from said barrel by said traveling valve ball displacing tool; said traveling valve ball displacing tool having opposed ends with a removable and replaceable flat-topped stinger having radiused edges extending from one end in aligned relationship respective to the traveling valve seat to displace said caged traveling valve ball each reciprocation of the plunger and thereby allow a fluid flow through the pump; said pump barrel and said standing valve assembly being removably affixed to said traveling valve ball displacing tool.

2. The downhole pump apparatus of claim 1 wherein said traveling valve ball displacing tool has a main body having threads on opposed ends thereof for thereby engaging the ends of said barrel and said standing valve.

3. The downhole pump apparatus of claim 1 wherein said traveling valve ball displacing tool remains completely and totally stationary during reciprocation of said plunger.

4. The downhole pump apparatus of claim 1 wherein said traveling valve ball displacing tool contains no moving parts.

5. The downhole pump apparatus of claim 1 wherein said passageways of said traveling valve ball displacing tool pass fluids containing suspended solids.

* * * * *